US007093694B2

(12) United States Patent
Brandt et al.

(10) Patent No.: US 7,093,694 B2
(45) Date of Patent: Aug. 22, 2006

(54) RELEASE HOLD MECHANISM WITH GRAVITY WEIGHTED INDICATOR FLAG

(75) Inventors: Staffan Brandt, Wauconda, IL (US); Howard Sommerfeld, Oak Forest, IL (US); Scott Natschke, Kankakee, IL (US); Wajih Kanjo, Lockport, IL (US)

(73) Assignee: WABTEC Holding Corp., Wilmerding, PA (US)

( * ) Notice: Subject to any disclaimer, the term of this patent is extended or adjusted under 35 U.S.C. 154(b) by 48 days.

(21) Appl. No.: 10/393,577

(22) Filed: Mar. 21, 2003

(65) Prior Publication Data

US 2004/0183368 A1 Sep. 23, 2004

(51) Int. Cl.
*B60T 17/22* (2006.01)
*G05G 5/06* (2006.01)
*G01D 13/22* (2006.01)

(52) U.S. Cl. ..... 188/1.11 R; 74/536; 116/303

(58) Field of Classification Search ..... 188/1.11 R, 188/33, 107, 106 F, 153 R, 265; 74/527–530, 74/535–537, 575, 577 R; 110/284, 258, 110/294, 303, 277
See application file for complete search history.

(56) References Cited

U.S. PATENT DOCUMENTS 3,176,539 A * 4/1965 Mersereau ..... 74/505
3,668,944 A * 6/1972 Natschke ..... 74/505
3,822,669 A * 7/1974 Schrag ..... 116/303
3,854,417 A * 12/1974 MacDonnell et al. .... 105/463.1
4,291,793 A * 9/1981 Klasing ..... 192/95
4,368,648 A * 1/1983 Housman et al. ..... 74/505

* cited by examiner

*Primary Examiner*—Xuan Lan Nguyen
(74) *Attorney, Agent, or Firm*—James Ray & Assoc.

(57) ABSTRACT

The present invention discloses a hand brake mechanism having a gravity based release hold mechanism with a visual indicator to prevent unwanted application of the railcar brakes and indicate such release hold condition. The release hold mechanism comprises a gravity based member pivotally linked to a release shaft preventing reverse rotation of the release shaft causing an unintended take-up of the chain. A detent retaining device disposed within the railcar hand brake housing further provides improve reliability of the operation. The gravity based member incorporates an indicator portion having a reflective coating to indicate such release hold position of the railcar hand brake.

20 Claims, 7 Drawing Sheets

RELEASE HOLD MECHANISM WITH GRAVITY WEIGHTED INDICATOR FLAG

FIELD OF THE INVENTION

The present invention relates, in general, to hand brake assemblies for use on railcars and, more particularly, this invention relates to a hand brake assembly equipped with a quick release mechanism.

BACKGROUND OF THE INVENTION

Railway car hand brake mechanisms are well known in the art. They usually include a relatively large, rotatable hand wheel disposed in a vertical plane and mounted on a shaft which, through a gear train, can rotate a chain drum to wind up a chain that is secured at its end remote from the chain drum to the brake rigging of the railway car. As the hand wheel is rotated in one direction, the brakes are applied and rotation of the hand wheel shaft in the opposite direction is prevented by a pawl which engages a detent wheel on the hand wheel shaft.

These hand brake mechanisms further include a clutch mechanism for facilitating gradual release of the brake. When a hand wheel is rotated clockwise (as viewed from the front of the unit), such rotation is transmitted directly through a drive shaft, a pinion, a gear, and a winding drum to take up slack of a chain connected to the brake rigging. When resistance is offered by the chain to further rotation of the hand wheel, such resistance, acting back through the drum, the gear, and pinion, causes a nut to be advanced on a threaded portion of the drive shaft to move against a ratchet member which is clamped between respective friction surfaces on the nut and on the drive shaft, thus causing the drive shaft, ratchet, and the nut to rotate as a unit. A pawl prevents rotation of the ratchet in the opposite direction. The hand wheel torque is increased until a state of static equilibrium is reached, or at the point at which the brakes are fully applied, whereupon rotation of the hand wheel is terminated, and the clamped ratchet, by means of the holding pawl, prevents the chain from unwinding.

The clutch mechanism also provides for quick release of the brakes by operating a release handle which effects disengagement of the normally engaged clutch and thereby allows free rotation of the pinion and gear to release the chain load while the nut and ratchet are held stationary by the holding pawl. The brakes may also be released by disengaging the pawl from the detent wheel but this causes rapid rotation of the hand wheel and the gears of the gear train.

To avoid rapid rotation of the hand wheel, hand brake mechanisms have been devised which are known as "quick release" mechanisms. U.S. Pat. No. 4,368,648 titled Hand Brake for Railroad Car teaches such a hand brake having a quick release mechanism. The quick release mechanism includes a releasable connecting means between the hand wheel shaft and the gear train. When the connecting means is released, the gears of the gear train rotate rapidly, without constraint by the pawl and detent wheel, but the hand wheel remains stationary. The teachings of U.S. Pat. No. 4,368,648 are hereby incorporated in present application by reference thereto.

It has been found that when a hand brake is quick released using the handle, the chain may not be fully expelled from the hand brake, thus maintaining residual tension due to lack of sufficient slack. This residual tension may set the hand brake, especially as the railcar travels around a curve. As a result the brakes may be applied unintentionally during railcar motion. As can be seen, it is desired to incorporate a positive means assuring that the brake is in a released and hold position and that the chain is fully released and provides sufficient slack to avoid unintentional setting of the hand brake.

Another long felt need in present hand brakes is related to their not having a positive visual indication of the hand brake being in the released hold position as viewed from the outside by railcar operating personnel and, particularly, providing such indication during darkness of nightfall. One of the challenges that must be overcome is the fact that railcars are painted in many different colors and may be contained within the same train consist.

SUMMARY OF THE INVENTION

A hand wheel in a handbrake mechanism for a railway car is used to rotate a gear wheel to apply the brakes. Such handbrake having a housing with a back wall and a front wall. There is a chain winding drum and a main gear wheel rotatably mounted on a drum shaft thereon disposed within such housing. The hand wheel having a shaft rotatably mounted on such housing having a bearing section at a first end and a hand wheel receiving section on a second end external to the housing. A ratchet wheel is mounted on the hand wheel shaft and rotatable with such hand wheel shaft intermediate the first and second ends thereof. A holding pawl in such housing cooperates with the ratchet wheel so as to prevent reverse rotation thereof. Additionally, a freely rotatable pinion on the hand wheel shaft engages the main gear wheel, such pinion having a radially extending flange cooperating therewith. A quick release mechanism cooperates with the holding pawl to allow reverse rotation of the ratchet wheel for releasing the chain. The hand brake incorporates a release hold mechanism having a release shaft attached to a quick release handle at one end. The release shaft also has a pivot portion engaging a fork-like portion of the movable cam to enable brake application. The release hold mechanism further includes a release bias means comprising a gravity based bias member substantially attached to one end of the bias shaft. The bias member is of a predetermined configuration and weight to rotate into an over-center condition under its own weight due to gravity and restrict rotation of the release shaft after the release hold condition has been achieved. The bias shaft is journaled within a front and rear bushing and has a pivot portion for pivotal coupling to a link. A link pivotally connects the bias shaft with the release shaft. The bias member further incorporates an indicator portion having a reflective coating for visual identification of the hand brake in such release hold position, especially during darkness and nightfall. The release hold mechanism may also include at least one detent disposed within the hand brake housing and engaging the detent portion of the release shaft to improve reliability of hand brake operation.

OBJECTS OF THE INVENTION

It is therefore a primary object of the present invention to provide a hand brake having a means to substantially maintain the hand brake in the release hold position.

A further object of the present invention is to provide a hand brake assembly which substantially prevents unintentional application of the braking apparatus during the railcar motion around a curve.

Yet a further object of the present invention is to provide a hand brake which provides a more reliable operation.

It is another object of the present invention to provide a hand brake having a visual indication means when the hand brake is in the released hold position.

Still yet another object of the present invention is to provide a hand brake having a visual indication means independent from the quick release handle.

It is still another object of the present invention to provide a hand brake having a visual indication means employable with railcars painted in different colors.

An additional object of the present invention is to provide a hand brake having a visual indication means easily seen during darkness or nightfall.

These and various other objects and advantages to the present invention will become more readily apparent to those persons skilled in the relevant art from the following more detailed description, particularly, when such description is taken in conjunction with the attached drawing Figures and with the appended claims.

DETAILED DESCRIPTION OF THE INVENTION

Figure 1:
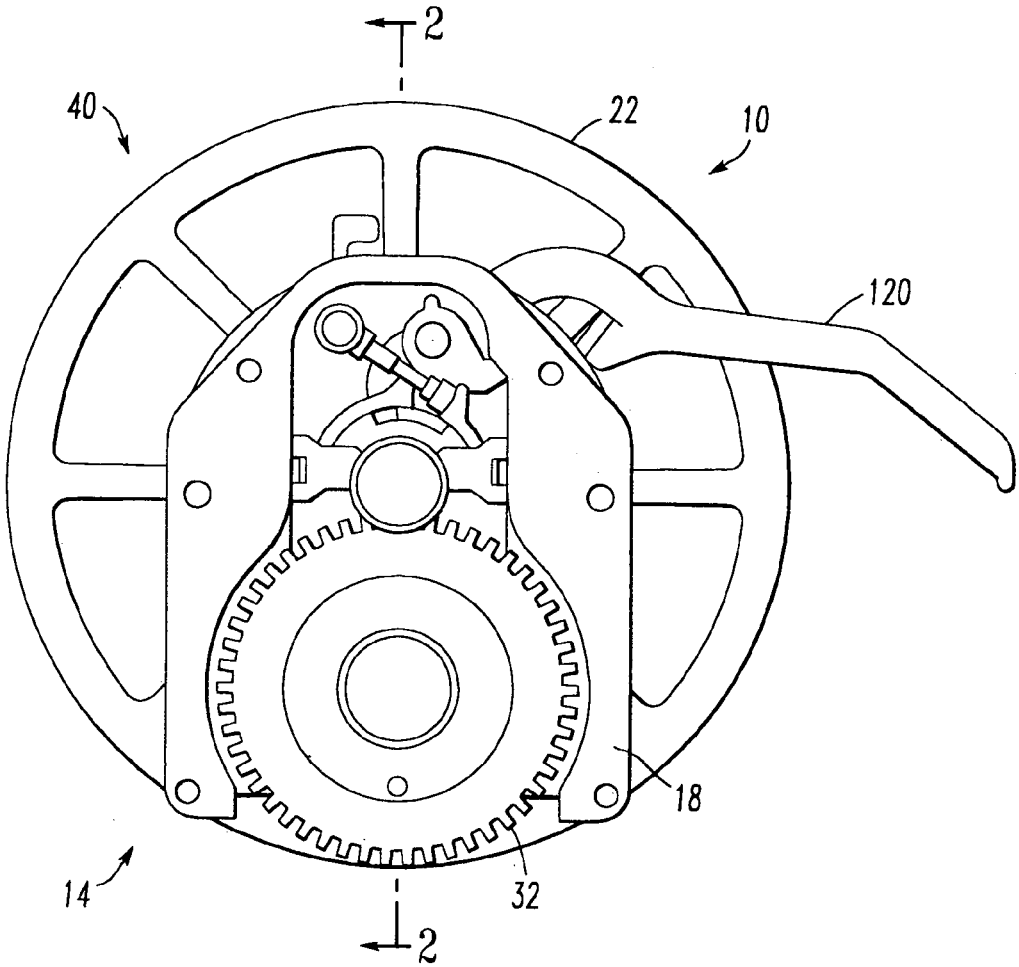
FIG. 1 is a rear planar view of a hand brake assembly of a presently preferred embodiment of the invention with the rear plate partially cut-out to expose internal components.

The following background information is provided to assist the reader to understand the environment in which the invention will typically be used. The terms used herein are not intended to be limited to any particular narrow interpretation unless specifically stated otherwise in this document.

Prior to proceeding to the more detailed description of the various embodiments of the present invention, for the sake of clarity and understanding of such invention, it should be noted that identical components having identical functions have been identified with identical reference numerals throughout each of the figures illustrated herein.

Figure 2:
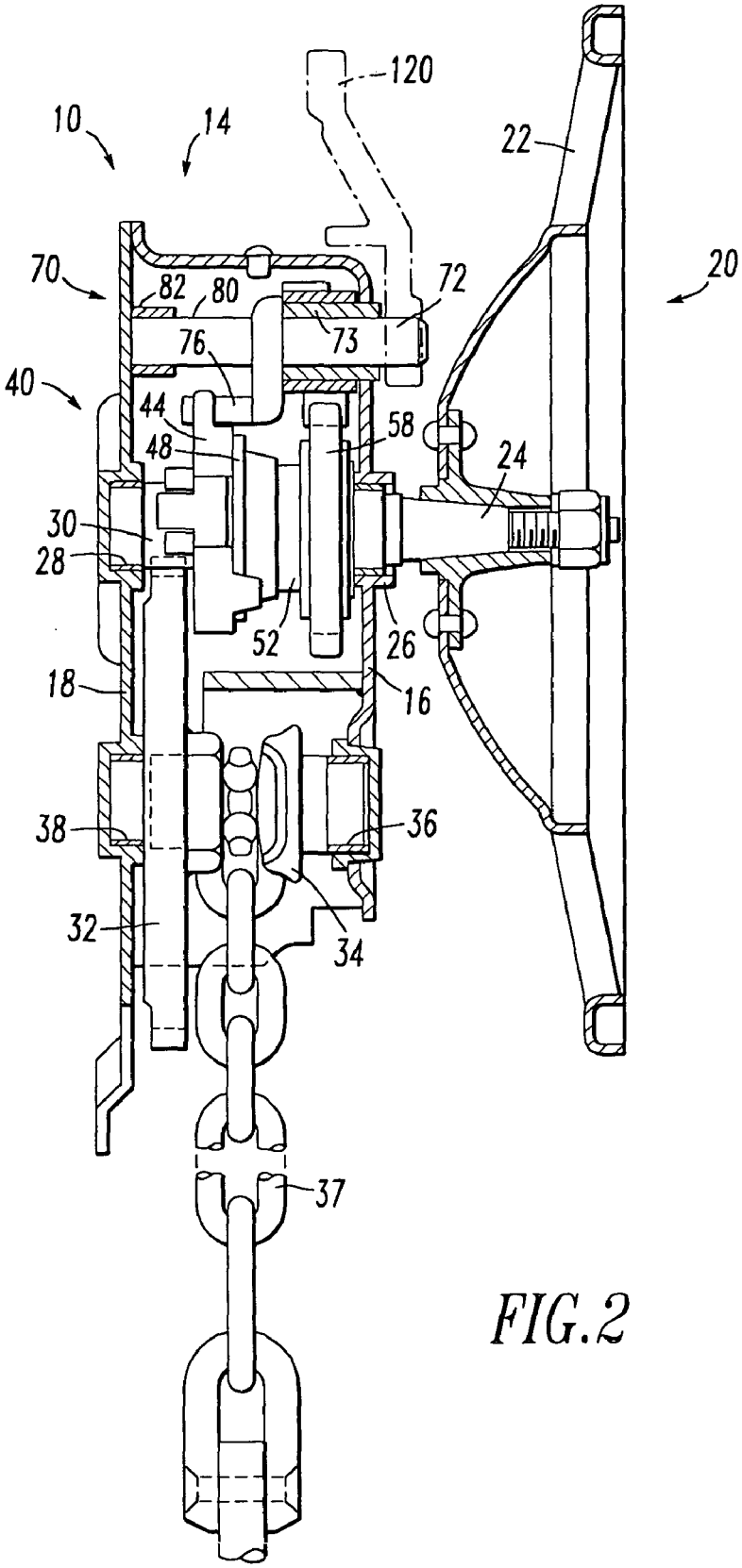
FIG. 2 is a cross-sectional view of the hand brake assembly, taken along the lines 2—2 of FIG. 1 also showing the chain component.

A hand brake, generally designated 10, for a railcar embodying the invention is shown in FIGS. 1 and 2. Such hand brake 10 includes a housing, generally designated 14, having a front plate 16 and a back plate 18. A driving mechanism, generally designated 20, is disposed in the upper portion of housing 14, such driving mechanism includes a hand wheel 22 secured to a drive shaft 24. Such drive shaft 24 is journaled for rotation in bearings 26 and 28 secured in front plate 16 and back plate 18, respectively.

Drive shaft 24 has secured thereon for rotation therewith, at the end adjacent bearing 28, a pinion 30 which substantially engages with a gear 32 for rotating a chain drum 34 journaled for rotation in bearings 36 and 38 secured on front plate 16 and back plate 18, respectively, in the lower portion of housing 14. Chain drum 34 engages alternate links of a chain 37 for either taking-up or letting-out the chain.

Figure 3:
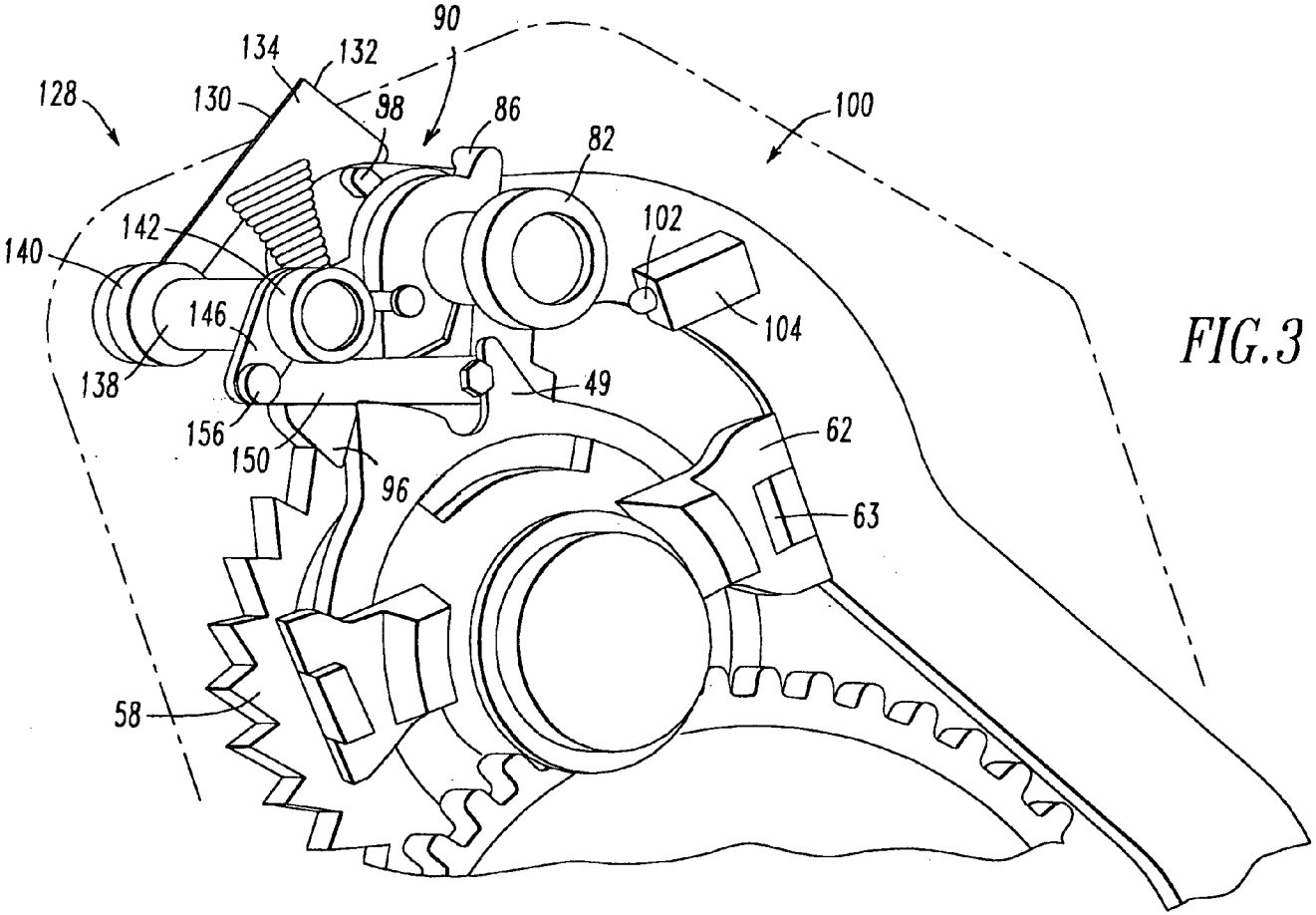
FIG. 3 is a cut-away partial rear perspective view of a hand brake assembly of the present invention, particularly showing the release hold mechanism when the hand brake is in an applied position.
Figure 5:
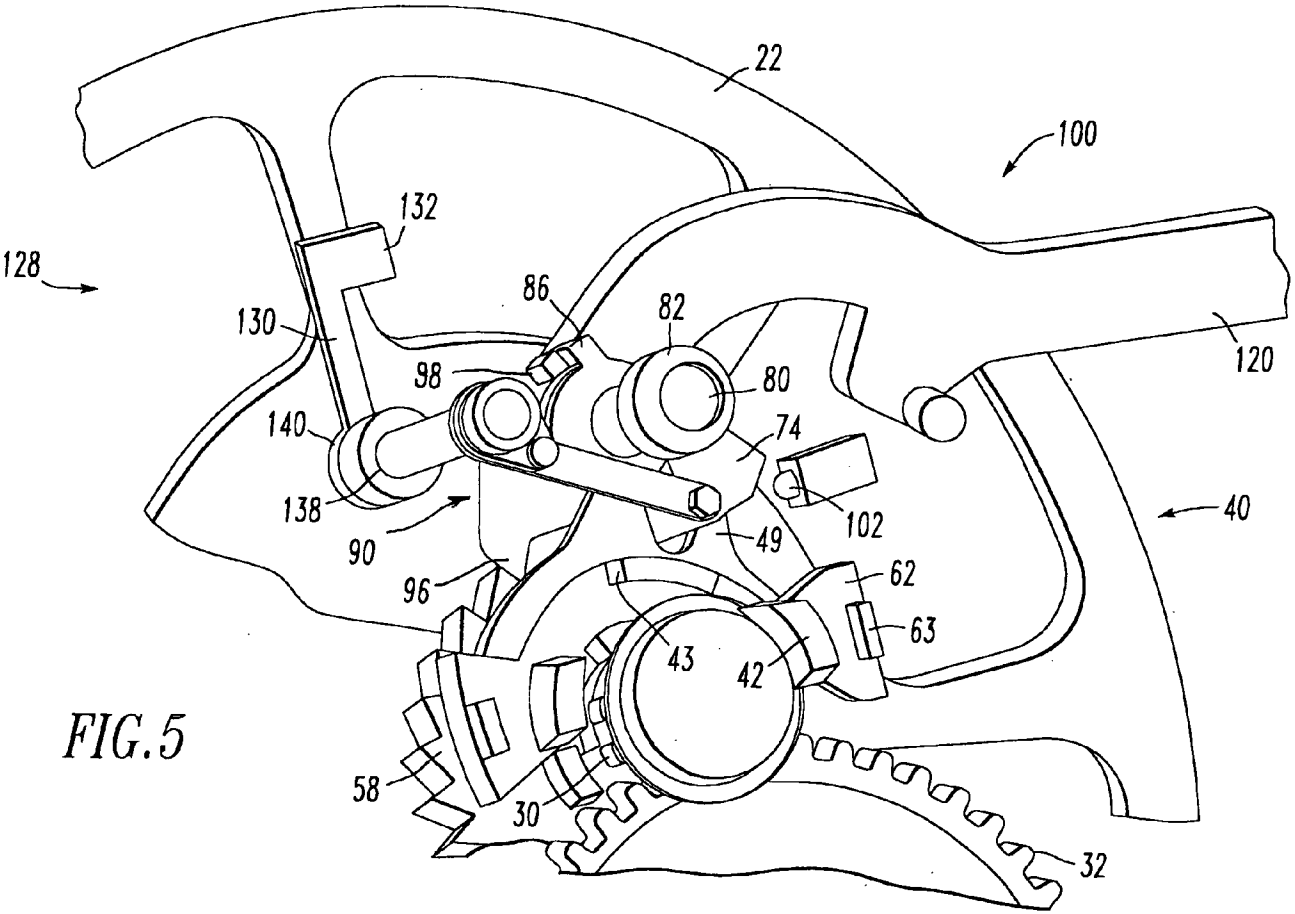
FIG. 5 is a cut-away partial rear perspective view of a hand brake assembly of the present invention, particularly showing the release hold mechanism when the hand brake is in released and hold position.

Also disposed in the upper portion of housing 14 and associated with the driving mechanism 20, is a clutch and quick release mechanism, generally designated 40, which may best be seen in FIGS. 2, 3 and 5. The clutch and quick release mechanism 40 comprises an annular stationary cam member 42 restrained from both axial and rotational movement, and a movable cam member, generally designated 44, rotatably disposed concentrically within such stationary cam 42, the movable cam 44 being rotatable relative to the stationary cam member 42 by means of complementary fast pitch threads 43 formed thereon.

An internally splined annular clutch collar 48 is provided with an annular flange (not shown) which concentrically surrounds the drive shaft 24, such collar 48 engaging with an externally splined nut, generally designated 52, attached to a threaded portion (not shown) of drive shaft 24.

Figure 7:
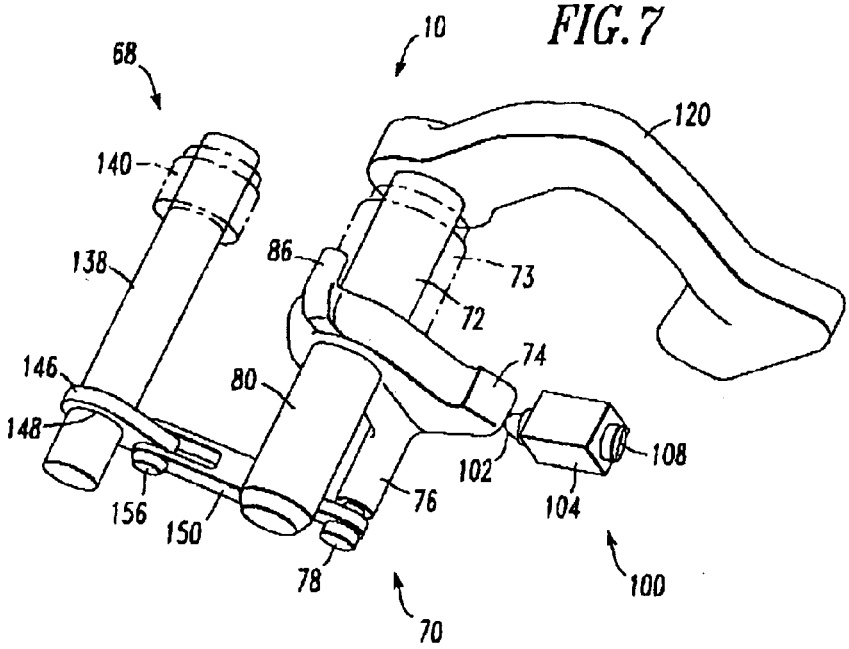
FIG. 7 is a partial perspective view of the release hold mechanism of the present invention.

The improvement to a hand brake 10 comprises a release hold mechanism, generally designated 68, of the present invention having a release shaft, generally designated 70, best seen in FIGS. 3, 5, and 7. The release shaft 70 has a first shaft portion 72 preferably journaled in a first release shaft bushing 73 perpendicularly secured in housing front plate 16 above the driving mechanism 20. Preferably, the release shaft 70 has a second shaft portion 80 journaled in a second release shaft bushing 82 perpendicularly secured in the rear plate 18 of the housing 14. The second shaft portion 80 is disposed substantially concentric to the first shaft portion 72.

Figure 8:
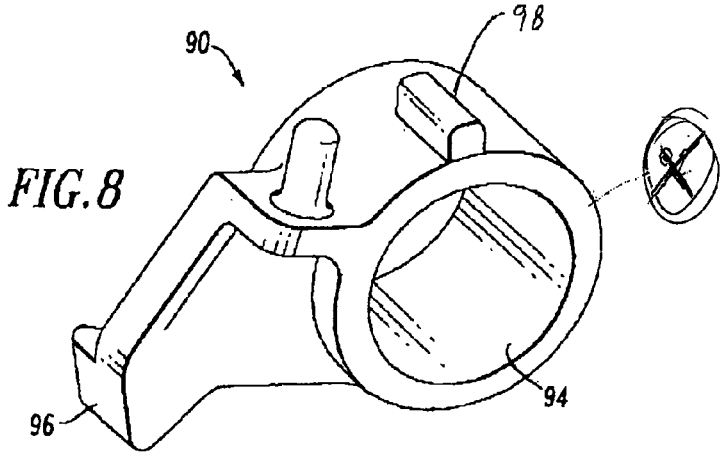
FIG. 8 is a perspective view of the holding pawl of the present invention.

A holding pawl, generally designated 90, best shown in FIG. 8, has a substantially cylindrical cavity 94 rotatably coupled to the first release shaft bushing 73 and a ratchet engaging portion 96 engaging ratchet wheel 58. The holding pawl 90 is free to ratchet thereon upon rotation of said ratchet wheel 58 in a counterclockwise direction, as viewed in FIGS. 3 and 5. A force receiving portion 86 of the release shaft 70 cooperates with the force transmitting portion 98 of said holding pawl 90 and is engaged by said force transmitting portion 98 during brake application cycle.

A release handle 120 is keyed at the external end of the first shaft portion 72 enabling rotation thereof in a clockwise direction, as viewed in FIG. 1, after the quick release without disengaging detent portion 74 of the release shaft 70.

There is a release bias means, generally designated 128, disposed within the hand brake 10 for biasing the release shaft 70 in the release and hold position and, more particularly, biasing the chain 37 from achieving tension. In the preferred embodiment the release bias means 128 comprises a bias member 130 of a predetermined configuration and of a predetermined weight, disposed adjacent the release handle 120. It is preferred that the bias member 130 is biased to the right of the vertical center line under its own weight, as viewed in FIG. 6, to gravity bias the release shaft 70 in the release hold position.

It is further preferred that such bias member 130 further includes an indicator portion 132 having a coating 134 easily recognizable from a distance. It is additionally preferred that the color of such coating 134 will differ from the color of the railcar (not shown). In the most preferred embodiment, a reflective coating is applied to such indicator portion 132 for ease of identification during the darkness or nightfall, with the use of a flashlight like device.

The bias member 130 is substantially attached to the first end of the bias shaft 138 by any suitable means such as welding, pinning, use of fasteners, use of adhesives and other well known methods. The first end of the bias shaft 138 is preferably pivotably journaled within a third bushing 140 perpendicularly secured within the front plate 16 of the brake housing 14. Preferably, the second end of the bias shaft 138 is pivotably journaled within a forth bushing 142 perpendicularly secured within the rear plate 18 of the brake housing 14. It is further preferred that such third bushing 140 and such forth bushing 142 are of substantially identical size.

A pivot portion 146 having a pivot cavity 148 is disposed substantially perpendicular to the bias shaft 138 adjacent its second end. A connecting link 150 is pivotally coupled to the pivot portion 146 with a first pivot retaining means 156 at one end and pivotally coupled to a pivot portion 76 of the release shaft 70 at the distal end with the second pivot retaining means 78. The second pivot retaining means 78 can be of any well known type, but preferably a threaded fastener type engaging a threaded cavity (not shown) of a predetermined diameter and a predetermined depth axially disposed within the pivot portion 76.

The bias means 128 further includes at least one detent retaining means, generally designated 100, attached to housing 14. The at least one detent retaining means 100 has a detent 102 preferably engaging a detent portion 74 of the release shaft 70 with the brake in the released and hold condition. In the preferred embodiment, the at least one detent retaining means 100 includes a detent housing 104 substantially attached to housing 14. A detent 102 is movably disposed within the housing 104, protruding beyond the housing 104 and is biased by the bias spring (not shown) toward the detent position. It is further preferred that adjustment means 108 disposed adjacent bias spring are provided to very the protrusion of the detent 102 and, more particularly, set the predetermined force of the at least one detent retaining means 100 to allow for component wear and overall tolerances of the hand brake and to provide substantial engagement of the release shaft 70 while the brakes are in a released and hold condition while allowing release of such release shaft 70 to apply such brakes.

Alternatively such at least one detent means 100 can be of the variety of mechanical, pneumatic, hydraulic or electrical detent means mounted internally or externally said hand brake housing 14. For example, such at least one detent means 100 can comprise a cylinder having a detent portion disposed at the end of the cylinder rod and receiving a fluid pressure signal to extend the rod in order to positively retain such release shaft 70 and receiving yet another fluid pressure signal to retract such rod at the beginning of the brake application cycle. Yet alternatively, such cylinder can be an electrical solenoid having similar interfaces.

Yet additionally, a leaf spring (not shown) of a predetermined strength can be attached at a predetermined position within the housing 14 engaging the detent portion 74 of the release shaft 70 to exert a predetermined force onto the release shaft 70.

In operation, in order to apply the brakes, hand wheel 22 is rotated counterclockwise, as viewed in FIG. 1, such rotation being transmitted through drive shaft 24, and pinion 30 to cause rotation of gear 32 in a counterclockwise rotation and thereby take-up slack of chain 37. Until such time that tension starts to build up in chain 37, shaft 24, pinion 30, nut 52, and clutch collar 48 all rotate as a unit during rotation of hand wheel 22. When tension begins to build up in the chain 37, such tension is reflected in gear 32 and transmitted back through pinion 30 to clutch collar 48.

Resistance to rotation by clutch collar 48, which is splined to nut 52, causes the nut 52 to advance on threads 25 and thereby clamp ratchet member 58 between friction surfaces (not shown). With ratchet 58 so clamped, continued rotation of wheel 22 causes drive shaft 24, the ratchet member 58, and nuts 52 to rotate as a single unit until the desired tension is attained on chain 37, while holding pawl 90 ratchets on such ratchet member 58. When the desired tension has been achieved on chain 37, rotation or application of torque on wheel 22 is terminated, and the holding pawl 90 engaged on clamped ratchet member 58 prevents the chain from unwinding, since such pawl permits only counter-clockwise rotation of the ratchet member 58.

Once applied, the brakes may be released either gradually or quickly.

For providing a gradual release of the brakes, hand wheel 22 is turned counterclockwise slightly to partially loosen nut 52 and thereby reduce the clamping force on ratchet member 58, which is restrained from rotation by holding pawl 90. The initial counterclockwise rotation of hand wheel 22 effects a corresponding rotation of the pinion 30 and gear 32, thereby easing tension on chain 37. Continued counterclockwise rotation of hand wheel 22 effects complete release of the load on chain 37 with gear 32 continuing to rotate until winding drum 34 has taken up all chain slack, that is, the amount of chain that had been taken up during the brake-applying phase of operation. When all chain slack has been taken up, further rotation of gear 32, pinion 30 and nut 52 is terminated with the brakes fully released. Clockwise rotation of hand wheel 22 is limited by a drive shaft pin (not shown) which projects into a slot (not shown) formed in nut 52.

Figure 4:
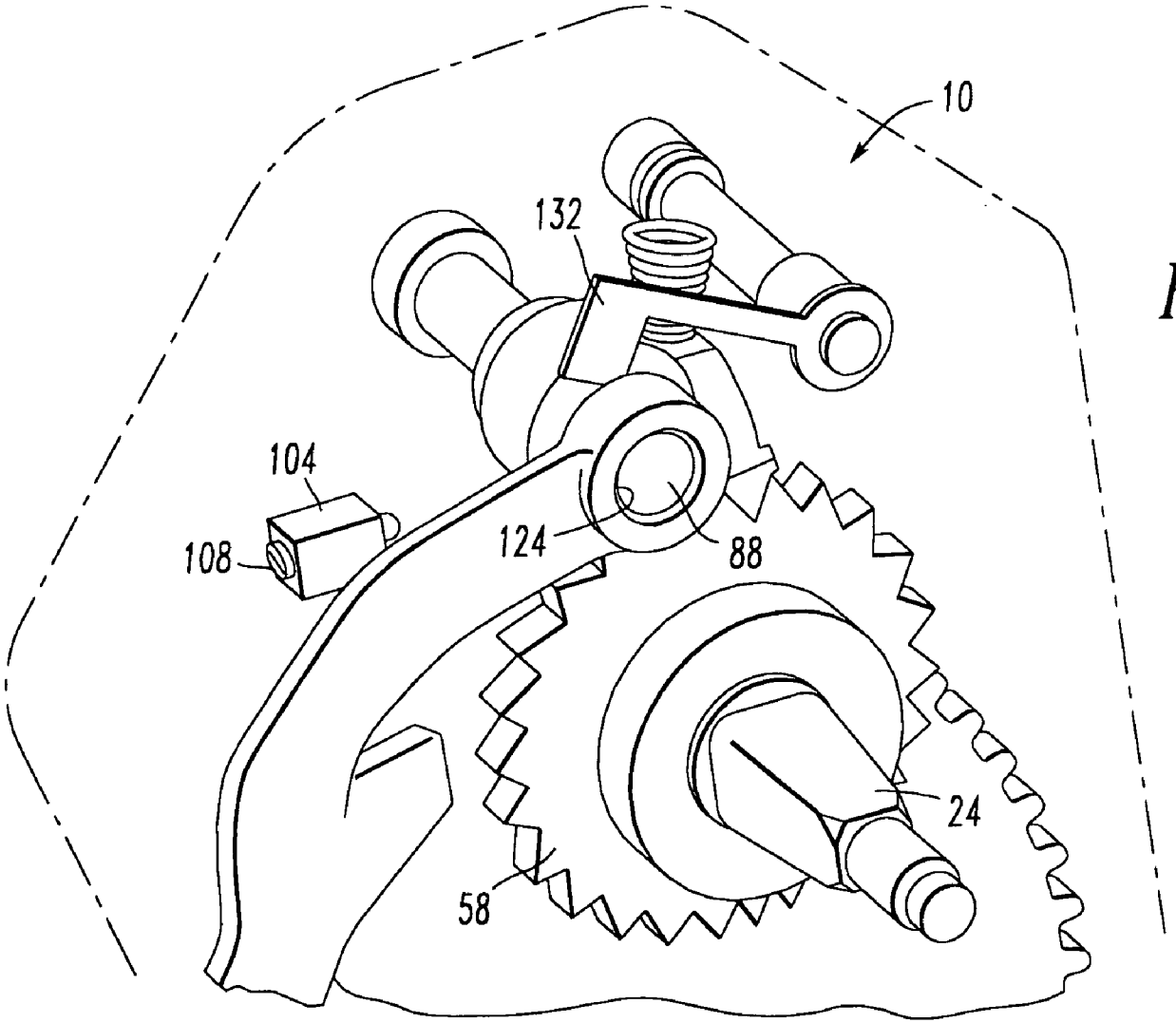
FIG. 4 is a cut-away partial front perspective view of a hand brake assembly of the present invention, particularly showing the release hold mechanism when the hand brake is in such applied position.
Figure 6:
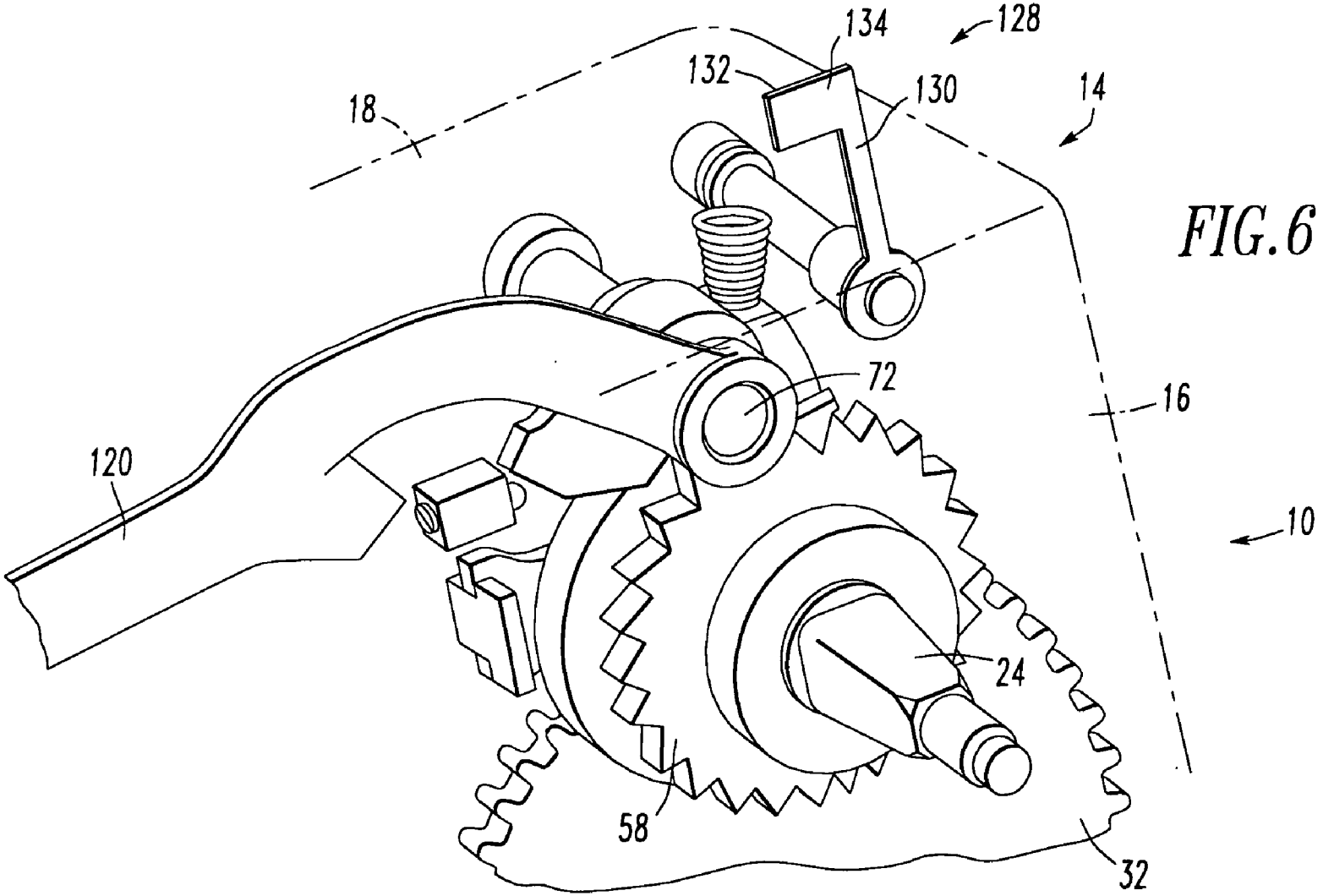
FIG. 6 is a cut-away partial front perspective view of a hand brake assembly of the present invention, particularly showing the release hold mechanism when the hand brake is in released and hold position.

A quick release of the brake application is caused by rotating release handle 120 (which is normally in an applied position) in a counter-clockwise direction, as viewed in FIG. 1. As shown in FIGS. 4 and 6, such release lever 120 is keyed onto a first end of the first shaft portion 72 by having a force transmitting portion 124 for engagement with a force receiving portion 88 disposed within the second end of the release shaft 72 for rotation of the release shaft 70 in a counter-clockwise direction, as viewed in FIG. 1.

Subsequent engagement of pivot portion 76 with a second fork portion 49 of movable cam 44, causes clockwise rotation of such movable cam 44. As was hereinbefore noted, the stationary cam 42 and movable cam 44 are provided with complementary fast-pitch threads 43, so that as movable cam 44 rotates clockwise, it moves axially outwardly of the stationary cam 42, in a right hand direction as viewed in FIG. 2, and carries with it clutch collar 48 by engagement of a flange (not shown) thereof. A groove (not shown) in movable cam 44 serves to constrain the collar flange (not shown) from relative axial and lateral movement with respect to movable cam 44 but does allow free clutch collar 48 rotation. Stationary cam 42 is restrained against both rotational and axial movement by engagement of lugs 62 formed on the periphery thereof and engaged in respective T-shaped elements 63 fixed to the inside surface of housing 14 (see FIG. 3). Thus, axial movement of movable cam 44 causes axial disengagement of external splines (not shown) formed on clutch collar 48 from internal splines (not shown) formed on pinion 30, thereby allowing such pinion 30 and gear 32 to rotate freely for releasing the load on chain 37, while drive shaft 24, nut 52, collar 48, and ratchet 58 are all held stationary by holding pawl 90.

Rotation of the release handle 120 in the counter-clockwise direction as viewed in FIGS. 1, 3, and 5, causes rotation of the release shaft 70 and, more particularly, causes the rotation of the bias member 130 in a counter-clockwise direction through the movement of the connecting link 150 causing rotation of the bias shaft 138 into an "overcenter" condition due to gravity of such bias member 130 assuring retention of the release shaft 70 in the release hold position.

The resulting retention of the release shaft 70 prevents such release shaft 70 rotation in a clockwise direction toward the applied position, further preventing rotation of the gear 32 and, more particularly, preventing partial release of the chain 37 so that motion around the curve will not cause unintended brake application due to the partially released chain 37 not having enough slack to withstand said railcar motion.

The resulting vertical orientation of indicator portion 132 provides a visual indication that the hand brake 10 is in the release hold position.

Engagement of the detent portion 74 of the release shaft 70 with the detent 102 of the detent means 100 further improves reliability of he hand brake operation.

When the brakes are fully released, the operator allows release handle 120 to return by gravity to the "applied" position from which the brakes may again be applied if desired.

For brake application, the clockwise rotation of the wheel 20 as viewed in FIGS. 4 and 6, rotates the holding pawl 90 in a counter-clockwise direction, causing counter-clockwise rotation of the release shaft 70 through the action of force transmitting portion 98 of the holding pawl 90 onto a force receiving portion 86 of the release shaft 70 and further causing disengagement of the detent portion 74 from the at least one detent means 100.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A release hold mechanism for a railcar hand brake, said release hold mechanism comprising:

(a) a release shaft having a first shaft portion with a first and a second end, said second end is keyed, said release shaft further having a detent portion disposed adjacent said first shaft portion at said first end, said detent portion having a force receiving portion, said release shaft additionally having a pivot portion extending outwardly from said detent portion, said pivot portion having a threaded cavity of a predetermined diameter and a predetermined depth, said threaded cavity axially disposed within said pivot portion;

(b) a release handle substantially engaging said second end of said first shaft portion, said release handle is keyed onto said second end of said first shaft portion; and (c) a holding pawl having a cavity for rotatable coupling to said release shaft at said first shaft portion, said holding pawl further having a ratchet engaging portion, said holding pawl additionally having a force transmitting portion cooperating with said force receiving portion of said release shaft.

2. A release hold mechanism according to claim 1, wherein said first shaft portion is journaled in a first release shaft bushing perpendicularly secured in a housing front plate of said hand brake.

3. A release hold mechanism according to claim 1, wherein said release shaft further includes a second shaft portion disposed adjacent said detent portion.

4. A release hold mechanism according to claim 3, wherein said second shaft portion is journaled in a second release shaft bushing perpendicularly secured in a housing rear plate of said hand brake.

5. A release hold mechanism according to claim 3, wherein said second shaft portion is substantially concentric to said first shaft portion.

6. A release hold mechanism according to claim 1, in which said hand brake further includes a release bias means disposed adjacent said release handle, said release bias means comprising:

(a) a bias shaft having a first end, said bias shaft further having a pivot portion disposed substantially perpendicular to said bias shaft, said pivot portion having a pivot cavity;

(b) a bias member of a predetermined weight and predetermined configuration disposed adjacent said release handle, said bias member substantially attached to said bias shaft at said first end thereof, said bias member rotating into an overcenter position due to gravity from said predetermined weight and said predetermined configuration; and (c) a connecting link pivotally coupled to said pivot portion of said bias shaft at said pivot cavity with a first pivot retaining means, said connecting link further pivotally coupled to said pivot portion of said release shaft with a second pivot retaining means.

7. A release hold mechanism according to claim 6, further having first end of said bias shaft pivotably journaled within a third bushing perpendicularly secured in said railcar hand brake front plate.

8. A release hold mechanism according to claim 6, wherein a second end of said bias shaft is pivotably journaled within a forth bushing perpendicularly secured within said railcar hand brake rear plate.

9. A release hold mechanism according to claim 6, wherein said second retaining means is a threaded fastener engaging said threaded cavity disposed within said pivot portion of said release shaft.

10. A release hold mechanism according to claim 6, wherein said release hold mechanism further includes an indicator portion for indicating said hand brake in release hold position.

11. A release hold mechanism according to claim 10, wherein said indicator portion includes a coating, said coating visually distinguishing said indicator portion from a railcar.

12. A release hold mechanism according to claim 11, wherein said coating is a reflective tape.

13. A release hold mechanism, according to claim 1, wherein said hand brake includes at lease one detent retaining means disposed within said hand brake.

14. A release hold mechanism according to claim 13, wherein, said detent retaining means comprising:

(a) a detent housing substantially attached to said railcar hand brake housing;

(b) a detent movably disposed within said detent housing, said detent protruding beyond said detent housing;

(c) a bias spring; and (d) adjustment means disposed adjacent said bias spring for varying a protrusion of said detent for exerting a predetermined force onto said release shaft.

15. A release hold mechanism according to claim 13, wherein said detent retaining means is a leaf spring attached to hand brake housing, said leaf spring is of a predetermined strength to exert a predetermined force onto said release shaft.

16. A release hold mechanism according to claim 13, wherein said at least one detent means is one of a pneumatic cylinder and a hydraulic cylinder, having a detent retaining portion disposed at an end of a cylinder rod and receiving a fluid pressure signal to extend said rod in order to positively restrain said release shaft from rotational motion and receiving yet another fluid pressure signal to retract said rod at a beginning of a brake application cycle to allow rotational motion of said release shaft.

17. A release hold mechanism according to claim 13, wherein said at least one detent means is a solenoid, having a detent retaining portion disposed at the end of the said solenoid shaft and receiving an electrical signal to extend said shaft in order to positively restrain said release shaft from rotational motion and receiving yet another electrical signal to retract said shaft at a beginning of a brake application cycle to allow rotational motion of said release shaft.

18. In a hand brake for a railcar, where a hand wheel is used to rotate a gear wheel to apply the brakes, having a housing with a back plate and a front plate, with a chain winding drum and a main gear wheel rotatably mounted on a drum shaft thereon, a hand wheel shaft rotatably mounted on said housing having a bearing section at a first end and a hand wheel receiving section on a second end external to said housing, a ratchet wheel rotatable with said hand wheel shaft intermediate said first and second ends thereof, a holding pawl in said housing which cooperates with said ratchet wheel so as to prevent reverse rotation thereof, a freely rotatable pinion on said hand wheel shaft and engaging said main gear wheel, said pinion having a radially extending flange cooperating therewith, a disengageable driving connection between said flange and said ratchet wheel, a quick release mechanism which cooperates with said holding pawl to allow one of a forward and a reverse rotation of said ratchet wheel for releasing said chain, and a release hold mechanism to maintain said hand brake in a substantially release hold position, the improvement comprising:

(a) a release shaft having a first shaft portion with a first end and a second end, said second end is keyed, said release shaft further having a detent portion disposed adjacent said first shaft portion at said first end, said detent portion having a force receiving portion, said release shaft additionally having a pivot portion extending outwardly from said detent portion, said pivot portion having a threaded cavity of a predetermined diameter and a predetermined depth, said threaded cavity axially disposed within said pivot portion;

(b) a release handle substantially engaging said second end of said first shaft portion, said release handle is keyed on said second end of said first shaft portion; and (c) a holding pawl having a cavity for rotatable coupling to said release shaft at said first shaft portion, said holding pawl further having a ratchet engaging portion, said holding pawl additionally having a force transmitting portion cooperating with said force receiving portion of said release shaft.

19. In a hand brake for railcar, according to claim 18, in which a release bias means is disposed adjacent said release handle, said release bias means comprising:

(a) a bias shaft having a first end, said bias shaft further having a pivot portion disposed substantially perpendicular to said bias shaft, said pivot portion having a pivot cavity;

(b) a bias member of a predetermined weight and predetermined configuration disposed adjacent said release handle, said bias member substantially attached to said bias shaft at said first end thereof, said bias member rotating into an overcenter position due to gravity from said predetermined weight and said predetermined configuration; and (c) a connecting link pivotally coupled to said pivot portion of said bias shaft at said pivot cavity with a first pivot retaining means, said link further pivotally coupled to said pivot portion of said release shaft with a second pivot retaining means.

20. In a hand brake for railcar according to claim 18, wherein said hand brake further includes a detent retaining means said detent retaining means comprising:

(a) a detent housing substantially attached to said railcar hand brake housing;

(b) a detent movably disposed within said detent housing, said detent protruding beyond said detent housing;

(c) a bias spring; and (d) adjustment means disposed adjacent said bias spring for varying protrusion of said detent and for exerting a predetermined force onto said release shaft.

* * * * *